United States Patent [19]

Foster

[11] Patent Number: 4,981,297

[45] **Date of Patent: * Jan. 1, 1991**

[54] SPHERICAL GOLF CLUB GRIP STRUCTURE

[76] Inventor: Craig L. Foster, 1813 Mark St. NE., Olympia, Wash. 98506

[ * ] Notice: The portion of the term of this patent subsequent to Feb. 14, 2006 has been disclaimed.

[21] Appl. No.: 322,183

[22] Filed: Mar. 13, 1989

[51] Int. Cl.[5] ..... A63B 59/14

[52] U.S. Cl. ..... 273/81 D; 273/165

[58] Field of Search ..... 273/81 D, 165, 183 D, 273/186 A, 166, 81.2, 193 R, 194 R

[56] References Cited

U.S. PATENT DOCUMENTS

| | | | |
|---|---|---|---|
| 715,225 | 12/1902 | Whitner | 273/165 |
| 1,573,612 | 2/1926 | Johnston | 273/165 |
| 2,223,437 | 12/1940 | Yeager | 273/165 |
| 2,481,778 | 9/1949 | Pearson | 273/165 |
| 3,036,836 | 5/1962 | Mason | 273/165 |
| 3,084,938 | 1/1963 | Kapanowski | 273/72 |
| 3,227,455 | 1/1966 | Hulsman | 273/165 |
| 3,358,811 | 1/1968 | Finney | 273/72 |
| 4,052,059 | 10/1977 | Rigsby | 273/165 X |
| 4,804,181 | 2/1989 | Foster | 273/165 X |

FOREIGN PATENT DOCUMENTS

| | | | |
|---|---|---|---|
| 322512 | 12/1929 | United Kingdom | 273/165 |

OTHER PUBLICATIONS

Tommy Bolt, Golf World, Aug. 26, 1977, p. 25.

*Primary Examiner*—Edward M. Coven
*Assistant Examiner*—Sebastiano Passaniti

[57] ABSTRACT

A golf training device in which there is a spherical golf club grip structure, substantially in the shape of a golf ball, with a cylindrical bore and separation point allowing attachment of the spherical golf club grip structure with a golf club handle. The outer surface of the spherical golf club grip structure contains indentations known as dimples to provide a realistic feeling of holding a golf ball while a golfer holds the spherical golf club grip structure and strokes a golf ball with a golf club. The sensation of holding a golf ball in the hand while stroking a golf ball allows the golfer to judge how much force is necessary to apply to the golf stroke in order to cause a golf ball to travel a desired distance to the hole in the putting green. When the spherical golf club grip structure is removed from the golf club, the sensation of holding a golf ball in the hand remains thus imparting greater sensation and increased skill while making a golfing stroke.

1 Claim, 4 Drawing Sheets

SPHERICAL GOLF CLUB GRIP STRUCTURE

BACKGROUND—FIELD OF INVENTION

This invention relates to a golf training aid and more particularly concerns a spherical golf club grip structure which imparts a feeling of holding a golf ball while making a golfing stroke.

BACKGROUND—CROSS-REFERENCE TO RELATED APPLICATION

Related to the present application is U.S. Pat. No. 4,804,181 titled Semi-Spherical Golf Club Grip Structure by Craig L. Foster, Olympia, Wash. U.S.A.. The present application is an advanced and improved grip structure in relation to the grip structure described in U.S. Pat. No. 4,804,181.

The present application describes a spherical structure which more faithfully imparts a feeling of holding a golf ball than the semi-spherical structure of U.S. Pat. No. 4,804,181.

BACKGROUND—DESCRIPTION OF PRIOR ART

It has long been taught in golfing instruction that a golf stroke is similar to a combination sidearm and underhand toss or roll of a golf ball. The putting and chipping strokes are shorter and less powerful versions of the full golfing stroke. In order to make their putting and chipping strokes more precise, and to gain control of the amount of force in such strokes, golfers would benefit from a device which imparts the feeling of holding a spherical dimpled golf ball while executing a putting or chipping stroke with a golf club. Prior art does not teach a method for constructing such a device.

Heretofore, various golf club grip structures have been employed to provide increased control in the golfer's use of force during a golf stroke.

One such grip structure in U.S. Pat. No. 4,804,181 to Foster, Feb. 14, 1989, comprises a semi-spherical grip structure with a dimpled surface in the form of a partial golf ball. The semi-spherical design of this grip structure creates an open section allowing attachment of the structure to a golf club grip. Feeling is lost, however, when the golfer's fingers are placed over the open section of the grip structure. The golfer would no longer have a sensation of holding a spherical golf ball. More specifically, the highly sensitive tips of the golfer's fingers could be placed partially over the open section of the grip structure resulting in a decrease in sensitivity and control. The present application describes a golf club grip structure that maintains spherical integrity thus providing a more realistic feeling of holding a golf ball while making a golf stroke.

While the U.S. Pat. No. 715,225 to Whitner, Dec. 2, 1902, teaches the use of a knob on the golf club that would create a sensation of holding a ball during the stroke, it also fails to teach use of a spherical dimpled surface of a golf ball on the handle of a golf club.

The deficiency of the semi-spherical structure is caused by the necessity of having to attach said structure to the enlarged handle section of a putter. A bore size in said structure large enough to allow attachment to a putter grip causes an enlarged section of the surface of the semi-spherical grip structure to be removed. The section thus removed prevents the structure from retaining spherical integrity and subtracts from its effectiveness to impart the feeling of holding a ball. One solution to this problem would be provided by two semi-spherical structures made to completely surround the putter grip. Such a described structure would resolve the problem of a gap in the surface of the grip structure but would cause a greater problem of the need for a mechanism to hold the two semi-spheres together. Such a mechanism would require a more extensive manufacturing process, and added costs to produce. The problems caused by the previously described structures are solved by the present invention. The spherical grip structure described herein teaches a novel method for connecting a spherically dimpled object to the putter grip. The resulting spherical grip structure is more effective as a training device than others found in the prior art. The spherical grip structure herein described is therefore new and superior in its ability to function as a golf training device. The prior art does not suggest a method for connecting a spherical dimpled grip structure to a golf club.

Prior art of record is found in U.S. Pat. No. 3,227,455 to Hulsman describing a cylindrical grip structure in the shape of a golf club grip with ribs to receive the golfer's fingers. The purpose of this grip structure is to provide the golfer with a firmer grip on the golf club. Hulsman's grip structure has none of the attributes found in the present invention and would give a golfer no beneficial result as a putting trainer. The problem solved by Hulsman of providing a removable rib section does not suggest a method for attaching a spherical dimpled structure to a golf club grip and thus must be viewed as being unrelated to the present invention. Hulsman did not recognize the problem of connecting a spherical device to the golf club grip. The use of a longitudinal split in a spherical structure utilizes a new principle of operation because of the unrelated nature of the described structures.

While the U.S. Pat. No. 715,225 to Whitner, Dec. 2, 1902, teaches the use of a knob on the golf club that would create a sensation of holding a ball during the stroke, it also fails to teach use of a spherical dimpled surface of a golf ball on the handle of a golf club.

Relevant prior art to the present invention is found in U.S. Pat. No. 2,481,778 to Pearson, Sept. 12, 1949. Pearson teaches an enlarged paddle type grip attachment to be held in the hand while making a stroke. The disadvantage of this grip attachment stems from its dissimilarity to the spherical dimpled surface of a golf ball. Holding a paddle in the hand while making a stroke gives the golfer little clue as to how much force would be required to make a golf ball travel a desired specific distance. Pearson is merely the equivalent of an oversized golf club grip, thus limiting its ability to create the sensation of rolling a golf ball with the hand while making a golf stroke.

The adjustable knob found in U.S. Pat. No. 4,052,059 to Rigsby, Oct. 4, 1977, likewise fails to include any detailed resemblance to a golf ball thus significantly limiting its ability to create the sensation of holding a golf ball while stroking.

A hand grip for golf clubs is found in U.S. Pat. No. 1,573,612 to Johnston, Feb. 16, 1926. Johnston teaches proper alignment and non-slipping the hands by use of projections or eccentric parts on the grip. The failure of Johnston to teach the sensation of holding a ball when stroking is a result of the lack of spherical shape to his grip. Johnston's grip is generally cylindrical and thus inapposite to the form of a sphere. Johnston, therefore, does not inherently create the sensation of holding a golf ball in the hand. A grip attachment is found in U.S. Pat. No. 2,223,437 to Yeager, 1940, shows a finger conforming device. The preferred form has indentations for the thumb and forefinger only and does not impart a feeling of holding a golf ball while making stroke. Yeager thus fails to predate any of the attributes or description of the present invention.

Prior art found in Golf World, Aug. 26, 1977; U.S. Pat. No. 3,036,836 to Mason, May 29, 1962; and British patent No. 322,512 to Wilson also suffer from a failure to create the sensation of holding a golf ball while stroking. Mason is a grip locator to improve hand positioning, and Golf World and Wilson are finger conforming devices which provide a firm grip but no sensation of holding a golf ball.

Golfers, therefore, would find it desirable to have a device which would accurately impart the feeling of holding a spherical dimpled golf ball shaped object while executing a golf stroke, thus increasing skill and developing control of the amount of force in a golf stroke.

OBJECTS AND ADVANTAGES

Accordingly I claim the following as objects and advantages of the invention; to provide an article of manufacture which faithfully and accurately produces the sensation of rolling or tossing a spherical dimpled golf ball with the hand while the golfer strokes a ball with a golf club, the present invention has the advantage over the prior art of providing a spherical rather than a semi-spherical configuration thus allowing the golfer to feel the true spherical shape of a golf ball while executing a golfing stroke, to provide a golf training device that can conform to various size golf club grips without manual adjustment of parts of the device, to provide such a golf training device that produces by muscle memory the sensation of holding a dimpled golf ball in the hand while stroking after such training device is removed from the golf club, to provide a golf training device to increase skill in longer shots of up to 100 yards by allowing the golfer to feel the required force of stroke necessary to throw a golf ball such a desired distance when stroking a ball, to provide a golf training device small enough to be easily transported in a pocket, to provide a golf training aid impervious to wear and usable for a lifetime.

Golfers are well accustomed to holding a golf ball in the hand and feeling its shape and weight. The shape and weight of a golf ball has a direct influence over the force necessary to roll or toss a golf ball a desired specific distance. When the golfer feels the dimpled surface of the spherical golf club grip structure as it is connected to a golf club handle, an increased sensitivity is gained as to how much force would be required in the golf stroke to make a golf ball travel a desired specific distance.

Another objective of this invention is to be inexpensive and easy to build, requiring only common tools and methods to manufacture.

Readers will find further objects and advantages of the invention from a consideration of the ensuing description and the accompanying drawings.

BRIEF DESCRIPTION OF THE DRAWINGS

Referring to the drawings

LIST OF REFERENCE NUMERALS

12 Spherical Golf Club Grip Structure
13 Cylindrical Bore
16 Separation Point
18 Concave Dimple
20 Golf Club Handle
22 Golf Club Shaft
24 Hand

SPHERICAL GOLF CLUB GRIP STRUCTURE—DESCRIPTION

Figure 1:
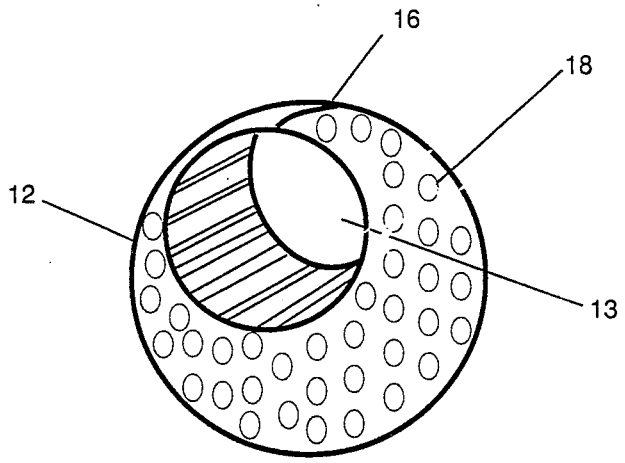
FIG. 1 is a perspective view of spherical golf club grip structure 12, cylindrical bore 13, separation point 16 and concave dimples 18 in accordance with the present invention.
Figure 2:
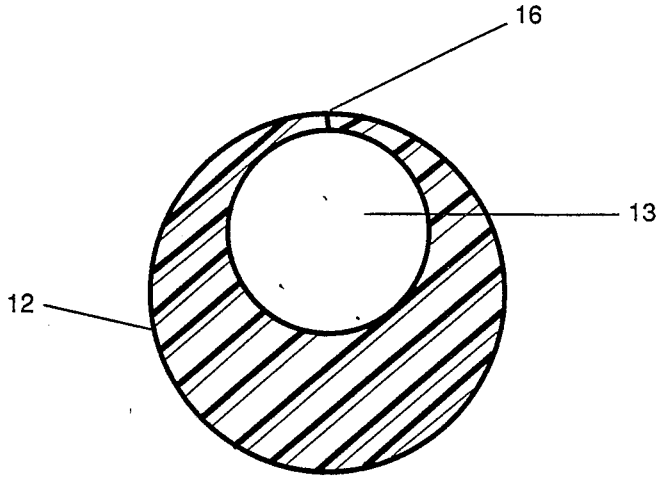
FIG. 2 is a cross-sectional view of the spherical golf club grip structure 12, and separation point 16.

FIG. 1 shows a spherical golf club grip structure 12 according to the preferred embodiment of the invention. The spherical grip structure 12 comprises a spherical ball about 1.68 inches or (42.67 mm) in diameter with an outer surface formed with concave dimples 18 which is preferably made of molded plastic. The spherical grip structure has a cylindrical bore 13 about 1 inch in diameter which allows the spherical grip structure to fit around the handle of a golf club as shown in FIG. 8. The center of cylindrical bore is approximately 15/16 inch from the furthest point on the outer circumference of spherical golf club grip structure 12, and 23/32 inch from the closest point of the outer circumference of spherical golf club grip structure 12. The thickness of spherical golf club grip structure 12 from the inner surface of cylindrical bore 13 to the outer circumference of structure 12 at its greatest point is approximately ⅝ or (0.625) inch. The thickness of spherical golf club grip structure 12 from the inner surface of cylindrical bore 13 to the outer circumference of structure 12 at its thinnest point is approximately ⅛ or (0.125) inch. Separation point 16 in the outer surface of spherical structure 12 allows the shaft of a golf club 22 as shown in FIG. 8 to be inserted into cylindrical bore 13 of the spherical structure 12. Once golf club shaft 22 is inserted into cylindrical bore 13, separation point 16 returns to its original position thus restoring the spherical integrity of structure 12.

SPHERICAL GOLF CLUB GRIP STRUCTURE—OPERATION

The spherical golf club grip structure 12 of FIG. 1 transmits to the golfer a feeling of holding and rolling a golf ball in the hand while stroking an actual golf ball with a golf club. Users will find it most helpful in developing an ability to stroke a golf ball the proper distance to the hole when on or around the putting green.

To install the spherical golf club grip structure 12 on a golf club handle 20, separation point 16 is pressed against golf shaft 22 causing separation point 16 to widen thus allowing golf shaft 22 to fit inside cylindrical bore 13 as shown in FIG. 8. Separation point 16 will automatically return to its natural position thus restoring the spherical integrity of grip structure 12.

Figure 3:
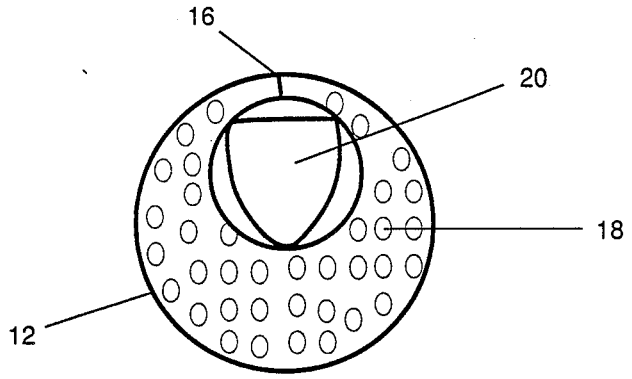
FIG. 3 is an elevational view of the spherical golf club grip structure 12 attached to a golf club handle 20.
Figure 4:
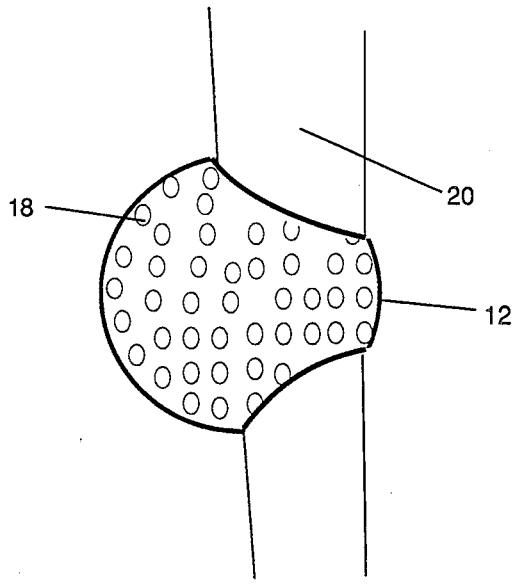
FIG. 4 is a side view of the spherical golf club grip structure 12 attached to a golf club handle 20.
Figure 5:
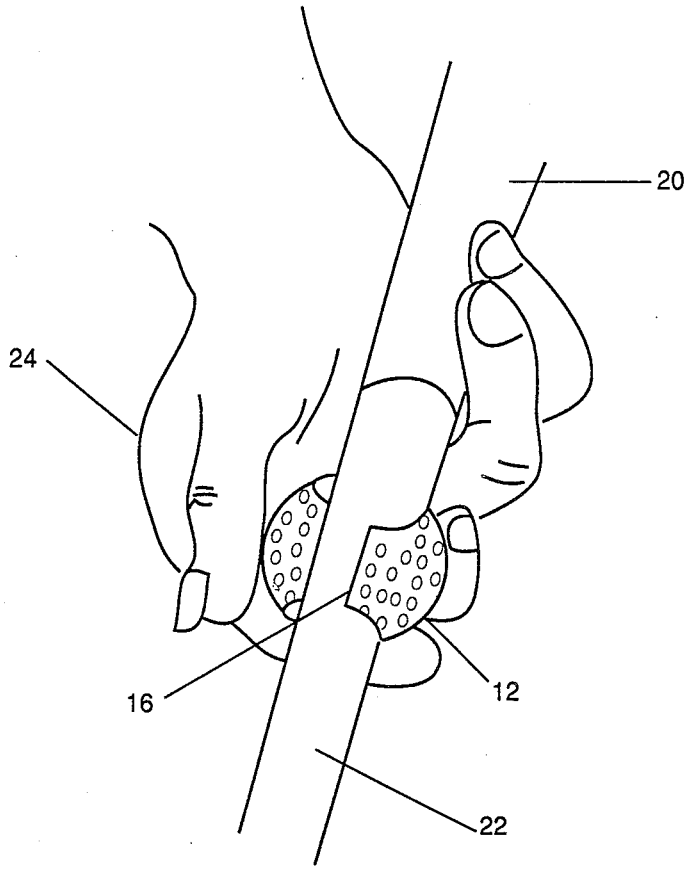
FIG. 5 is a perspective view of a golf club grip structure 12 being mounted onto golf club handle 20 by applying pressure of golf club shaft 22 to separation point 16 with hand 24.
Figure 6:
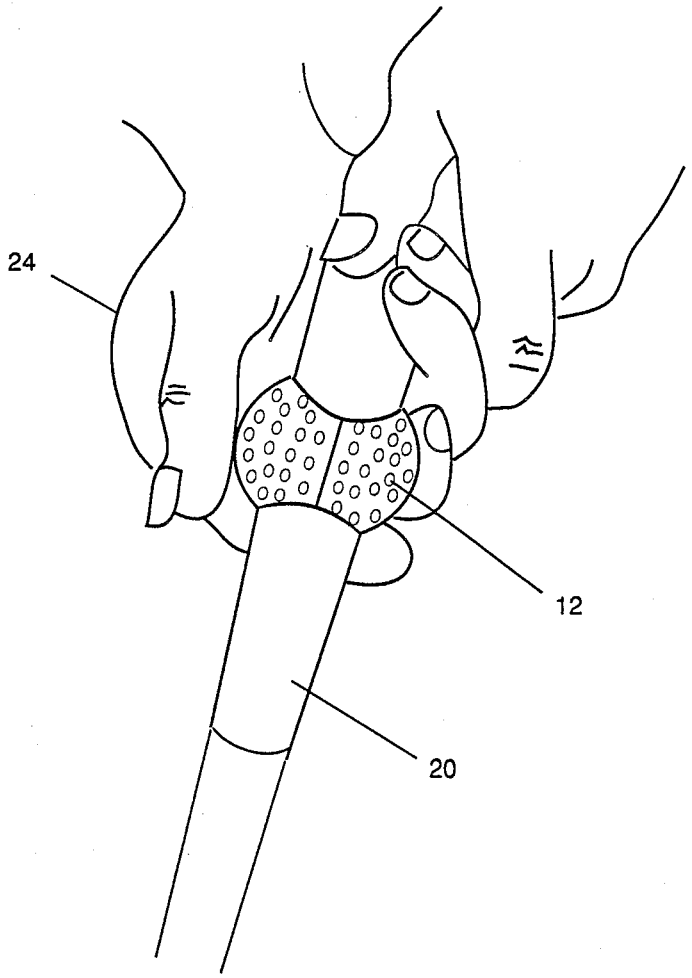
FIG. 6 is a perspective view of the spherical golf club grip structure 12 mounted on golf club handle 20 and held in hand 24 of golfer.

To position spherical golf club grip structure 12 on golf club handle 20, the spherical golf club grip structure 12 is pulled upwards onto the golf club handle 20 to a point where the golfer's right hand holds golf club handle 20 when executing a golf stroke. Spherical golf club grip structure 12 is held in the desired position on golf club handle 20 by means of frictional contact with golf club handle 20, and the inner surface of cylindrical bore 13 as illustrated in FIG. 3.

Once installed into the desired position on golf club handle 20, the golfer holds the spherical golf club grip structure in the fingers of the hand as if he or she were rolling a ball. One preferred method is to hold the spherical golf club grip structure 12 in the thumb, index, and long finger of the hand.

While holding the mounted spherical golf club grip structure 12 in the described manner, the golfer can now practice stroking actual golf balls with a golf club. The golfer is able to feel the relationship between the force of the stroke causing the golf ball to travel a specific distance and the feeling of rolling a ball such a distance. Because the spherical golf club grip structure 12 is held in the hand, the golfer develops skill through muscle memory for how hard to stroke a golf ball to make it travel a desired specific distance.

The golfer should practice stroking a golf ball various distances to further develop feel and skill in causing the golf ball to travel a desired specific distance. The development of skill herein described is similar to gaining skill in throwing a baseball or football in that such balls are held in the hand while executing a throw. The feeling of holding a baseball or football in the hand while observing the distance the ball travels contributes greatly to the acquisition of skill in throwing such a ball a desired specific distance. Similar skill development results from practicing the golfing stroke with a spherical golf club grip structure 12 held in the hand and installed on a golf club handle 20.

When the spherical golf club grip structure 12 is removed from the golf club handle 20 by reversing the installation procedure, the golfer will retain the feeling of holding a golf ball in the hand when executing a golf stroke. The golfer's ability to stroke a golf ball a desired specific distance during actual play will thus be increased from use of the spherical golf club grip structure.

Users of the spherical golf club grip structure will also find the advantageous result of increased skill in shots of up to 100 yards distance from the putting green. The feeling of holding a golf ball in the hand gained from use of the spherical golf club grip structure 12 will allow the golfer to better judge the desired power necessary for a shot of such distance.

While the above description contains many specificities, the reader should not construe these as limitations on the scope of the invention, but merely as exemplifications of a preferred embodiment thereof. Those skilled in the art will envision many other possible variations are within its scope. For example, skilled artisans will readily be able to change the dimensions and shape of the embodiment. They will also be able to make the spherical golf club grip structure of alternative materials. They also can make various adjustment mechanisms allowing use of the spherical golf club grip structure with unusually large or small golf club handles. As an example, an adjustable lever mechanism may be employed inside the cylindrical bore to allow attachment to various large or small club handles. Skilled artisans could make the spherical golf club grip structure as a permanent part of a golf club handle. The spherical golf club grip structure 12 could also be made of semi-spherical components which fit together and surround a golf club handle in a spherical manner. Accordingly the reader is requested to determine the scope of the invention by the appended claim and its legal equivalents, and not by the examples which have been given.

I claim:

1. An improved golf club training structure comprising a shaft with a handle portion, thereon, and a spherical golf club grip knob having an outer surface and a cylindical bore axially disposed, therethrough, adapted to surround said handle portion of said club, said knob having symmetrically placed circular identification known as dimples, thereover, as a means to transmit to a golfer the sensation of holding a golf ball in the hand while executing a golf stroke, said outer surface forming a separation point as a means of attaching said structure to said shaft whereby said separation point will restore spherical integrity of the grip structure after attachment to or detachment from said shaft.

* * * * *